US011268260B2

(12) United States Patent
Coupland

(10) Patent No.: US 11,268,260 B2
(45) Date of Patent: Mar. 8, 2022

(54) CUTTING ASSEMBLY

(71) Applicant: CCMJ SYSTEMS LTD, Highland (GB)

(72) Inventor: John Coupland, Highland (GB)

(73) Assignee: CCMJ SYSTEMS LTD, Highland (GB)

( * ) Notice: Subject to any disclaimer, the term of this patent is extended or adjusted under 35 U.S.C. 154(b) by 530 days.

(21) Appl. No.: 16/465,192

(22) PCT Filed: Nov. 1, 2018

(86) PCT No.: PCT/GB2018/053172
§ 371 (c)(1),
(2) Date: May 30, 2019

(87) PCT Pub. No.: WO2019/086884
PCT Pub. Date: May 9, 2019

(65) Prior Publication Data

US 2020/0002916 A1 Jan. 2, 2020

(30) Foreign Application Priority Data

Nov. 6, 2017 (GB) ..... 1718325

(51) Int. Cl.
*E02F 5/08* (2006.01)
*E02F 3/18* (2006.01)
(Continued)

(52) U.S. Cl.
CPC ..... *E02F 5/08* (2013.01); *E02F 3/188* (2013.01); *E02F 3/20* (2013.01); *E02F 3/241* (2013.01); *E02F 3/246* (2013.01); *E02D 17/13* (2013.01)

(58) Field of Classification Search
CPC ..... E02F 3/08; E02F 3/188; E02F 3/20; E02F 3/241; E02F 3/246; E02D 17/13
See application file for complete search history.

(56) References Cited

U.S. PATENT DOCUMENTS 4,718,504 A 1/1988 Terashima et al.
4,718,731 A 1/1988 Bauer et al.
(Continued)

FOREIGN PATENT DOCUMENTS

DE 19901556 A1 8/2000
EP 0333577 A1 9/1989
(Continued)

OTHER PUBLICATIONS

CCMJ Systems Ltd, International Application No. PCT/GB2018/053172, International Search Report, dated Jan. 28, 2019.
(Continued)

*Primary Examiner* — Jessica H Lutz
(74) *Attorney, Agent, or Firm* — Moore & Van Allen PLLC; W. Kevin Ransom

(57) ABSTRACT

Provided is a cutting wheel assembly comprising: a frame having two spaced support pillars, each having an intermediate portion at an angle to upper and lower portions; a pair of outer cutting wheels arranged either side of an inner cutting wheel all supported on the lower portions of the support pillars about a common axis of rotation; each cutting wheel having a central hub portion about which an annular cutting portion is provided having a respective cutting diameter; the inner cutting wheel having a different cutting diameter to that of the outer cutting wheels, and the central hub portions of neighboring cutting wheels defining a respective gap in which the intermediate portion of a respective pillar is received; at least one of the annular cutting portions of the inner and/or the outer cutting wheels having one or more rim portion(s) that overlap each gap so the annular cutting portions provide a cutting action along a continuous line of cut.

20 Claims, 4 Drawing Sheets

(51) Int. Cl.

| | |
|---|---|
| ***E02F 3/20*** | (2006.01) |
| ***E02F 3/24*** | (2006.01) |
| *E02D 17/13* | (2006.01) |

(56) References Cited

U.S. PATENT DOCUMENTS

| | | | |
|---|---|---|---|
| 4,930,940 | A | 6/1990 | Charlier et al. |
| 5,056,959 | A | 10/1991 | Cannac et al. |
| 2013/0227862 | A1 | 9/2013 | Schroeppel et al. |
| 2014/0013634 | A1 | 1/2014 | Huber |

FOREIGN PATENT DOCUMENTS

| | | | |
|---|---|---|---|
| EP | 0402247 | A1 | 12/1990 |
| EP | 0649716 | A1 | 4/1995 |
| EP | 1847650 | A2 | 10/2007 |
| FR | 2594864 | A1 | 8/1987 |
| IT | UD930212 | A1 | 4/1995 |
| JP | H02112731 | U | 9/1990 |
| WO | 2012045327 | A1 | 4/2012 |
| WO | 2013007968 | A2 | 1/2013 |
| WO | 2016077363 | A1 | 5/2016 |

OTHER PUBLICATIONS

CCMJ Systems Ltd, International Application No. PCT/GB2018/053172, Written Opinion, dated Jan. 28, 2019.

PRIOR ART
10
20
22
16
18B
19
50
18A
12B
12A
12
14
FROM FRONT

FROM REAR

FROM REAR

PRIOR ART

End Elevation

Elevation

Sectional Elevation

End Elevation

Elevation

Sectional Elevation

CUTTING ASSEMBLY

CROSS-REFERENCE TO RELATED APPLICATION(S)

This application is a national stage application (filed under 35 § U.S.C. 371) of PCT/GB2018/053172, filed Nov. 1, 2018 of the same title, which, in turn, claims priority to Great Britain Application No. 1718325.2 filed Nov. 6, 2017; the contents of each of which are hereby incorporated by reference.

FIELD OF THE INVENTION

The invention relates to an improved cutting assembly for use in a milling machine for cutting (also known as milling) a trench for a diaphragm wall, and/or for cutting (milling) along a height of a concrete panel for such a wall.

BACKGROUND

Concrete embedded retaining walls such as diaphragm walls and slurry walls have been part of foundation construction for sixty years. Modern hydraulic diaphragm wall milling machines, cutters and grabs are capable of digging to depths of over 50 to 60 m or even over 100 m with a high degree of positional accuracy. Technical challenges remain in the process of joining concrete panels at immense depths. Forming the joint between successive panels has always been one of the most difficult and time consuming elements of the process. Existing construction methods of forming joints involves using, and then removing, stop-ends, or preparing the vertical end face of the panel to form a joint by running a milling machine down it.

Preparing of a first panel end face is described in FR2594864 ROCHMANN, U.S. Pat. No. 4,930,940 and EP0333577 CHARLIER, EP0649716 CASAGRANDE, EP0402247 and U.S. Pat. No. 5,056,959 both to CANNAC, DE19901556 BRUCKNER, ITUD930212 CASAGRANDE, EP1847650 CASAGRANDE, and WO2013007968 COUPLAND.

Usually milling machines push against an opposing rear vertical face of an adjoining trench to provide sufficient purchase against the concrete panel to cut the panel. In this system, typically two opposing cutting wheels with spaced apart, parallel, rotary axes are used to push against an opposing wall of an adjoining trench and against the vertical end face of the concrete panel so as to mill it. Alternatively, milling machines may be anchored to the vertical end face to resist lateral forces during cutting (milling).

WO2013/007968 COUPLAND describes a milling machine (see FIG. 23) that is anchored to the end face and which uses spaced apart milling wheels along a common horizontal axis. COUPLAND describes a multi-stage process of firstly casting a vertical guideway tube in a first concrete panel, next in a single pass cutting away a sacrificial portion and using the opened guideway tube as a guide for anchoring to and trimming the wall, resisting lateral movement away from the end face. Before this, a second trench is dug against the wall to be trimmed and then, after trimming, concrete is cast into it to form the second panel.

U.S. Pat. No. 4,930,940 CHARLIER describes a system for guiding an excavation tool with a rotary cutting wheel. EPO649716 CASAGRANDE describes an excavation tool with a rotary cutter assembly and a thrust and guide assembly on opposite sides. EP184650 CASAGRANDE describes an excavation device with milling wheels. US2013227862 SCHROEPPEL describes a trench wall cutter having a cutting wheel with ground working tools arranged along an annular path around the axis of rotation. US2014013634 HUBER describes a cutting wheel with a trench cutter with cutting tools for removing ground. WO2016077363 SIEBERT describes a cutting element for a cutting drum.

To improve water tightness and strength, a shear key shape may be provided in the end face of a first concrete panel, typically in the form of a vertical protrusion, or a vertical recess, vertical along the height of the end face. Where one or more wheels at one vertical level (on the milling machine) are used, there must necessarily be either a gap at their outermost sides or in between neighboring wheels to accommodate axle support structures. This means that at least part of the width of the concrete end face is not cut (milled) and so is not appropriately prepared, threatening the quality of the joint and water tightness. Chain driven milling wheels may be used with teeth in the chain to try to achieve this effect. Nevertheless, to provide a full milling action across the entire width of an end face of a concrete panel is problematic and difficult to achieve, particularly when a shear rebate is desired.

SUMMARY OF THE INVENTION

The present invention seeks to alleviate one or more of the problems of the art.

In a first aspect of the invention there is provided a cutting wheel assembly (e.g. for cutting a trench and/or for cutting along a height of a concrete panel) comprising: a frame having two (preferably generally vertical) spaced support pillars, each pillar having an upper portion, an intermediate portion and a lower portion, the intermediate portion at an angle (optionally the same angle) to the upper and lower portions; a pair of outer cutting wheels arranged either side of an inner cutting wheel all supported on the lower portions of the support pillars in a rotatable manner about a (e.g. generally horizontal) common axis of rotation; each cutting wheel having a central hub portion about which an annular cutting portion is provided, each annular cutting portion having a respective cutting diameter; the inner cutting wheel having a different cutting diameter to that of both the outer cutting wheels, and the central hub portions of neighboring cutting wheels defining a respective gap (e.g. a horizontal or inclined gap) in which the intermediate portion of a respective pillar is received; at least one of the annular cutting portions of the inner cutting wheel and/or the outer cutting wheels having one or more rim portion(s) that overlap (e.g. extend laterally over) each gap, so the annular cutting portions of the cutting wheels provide a cutting action along a continuous line of cut in a lateral direction (e.g. respective cutting widths of each annular cutting portion abutting or overlapping one another).

In a second aspect of the invention there is provided a method of cutting a trench or an end face of a concrete panel comprising using the apparatus recited in the claims.

Preferably all the wheels are arranged on a common axle, supported by the pillars.

Preferably the annular cutting portions of the outer cutting wheels both have the same first cutting diameter (D1), and the annular cutting portion of the inner cutting wheel has a second cutting diameter (D2) which is different from the first cutting diameter (D1).

Preferably the first cutting diameter (D1) of the outer cutting wheels is larger than the second cutting diameter (D2) of the inner cutting wheel.

Preferably the first cutting diameter (D1) of the outer cutting wheels is smaller than the second cutting diameter (D2) of the inner cutting wheel.

Preferably each annular cutting portion of each wheel has a respective cutting width and in which the respective cutting widths of the annular cutting portions abut or overlap one another to provide a cutting action along a continuous (e.g. quasi/near) line of cut in a lateral direction.

Preferably the gap has an opening which faces in a lateral (horizontal) direction e.g. the opening may be at an angle to the vertical but it has a vertical component to it, so that it faces outwards in a lateral (typically horizontal) direction to receive laterally extending intermediate portions of the support pillars.

Preferably which the central hub portion of at least one of the outer cutting wheels and/or the inner cutting wheel, comprises a recess to receive a motor (preferably a hydraulic motor).

Preferably each of the central hub portions of the outer cutting wheels comprise a recess, and, within each recess, a motor (preferably a hydraulic motor).

Preferably at least one power line (preferably one or more hydraulic power lines) is located within one or both support pillars to provide at least one central hub portion with power.

Preferably the inner cutting wheel is of greater cutting diameter than the outer cutting wheels and the annular cutting portion of the inner cutting wheel is wider than its central hub portion defining a recess, such as a recess to receive a motor.

Preferably the recess is of frustoconical shape in cross-section (e.g. with an inclined side wall to allow a greater extent of cutting teeth and/or angled cutting teeth to overlap laterally the gap between the inner and outer cutting wheels).

Preferably the inner cutting wheel is of lesser cutting diameter than the outer cutting wheels and each outer cutting wheel has an annular portion wider than its central hub portion, defining a recess such as a recess to receive a motor.

Preferably the recess is of frustoconical shape in cross-section. (e.g. with an inclined side wall to allow a greater extent of cutting teeth and/or angled cutting teeth to overlap laterally the gap between the inner and outer cutting wheels).

Preferably each pillar has an inclined intermediate portion between upper and lower vertical portions.

Preferably in which the intermediate portion is at an obtuse angle (e.g. of greater than 90° and less than 180°) to the upper and lower portions.

Preferably the intermediate portion is at an angle of, generally or substantially, 90° to the upper and lower portions.

Preferably in which each pillar has a horizontal intermediate portion between upper and lower portions.

Preferably each pillar has a first bend between straight upper and intermediate portions to provide a first change in direction so that the intermediate portion is at an angle to the upper portion.

Preferably each pillar has a second bend between straight upper and intermediate portions to provide a second change in direction so that the intermediate portion is at an angle to the lower portion (e.g. in effect this provides a dogleg-shaped pillar)

Preferably at least one intermediate portion extends inwardly toward the inner cutting wheel.

Preferably at least one intermediate portion extends outwardly away from the inner cutting wheel.

Preferably the upper and lower portions of the support pillars are substantially vertical.

Several embodiments of the invention are described and any one or more features of any one or more embodiments may be used in any one or more aspects of the invention as described above.

BRIEF DESCRIPTION OF THE DRAWINGS

The present invention will now be described by way of example only, with reference to the following Figures. In this document like referenced numerals refer to like features and reference numerals are used for purposes of illustration of example embodiments and are not considered to be limiting.

DETAILED DESCRIPTION OF THE INVENTION

Figures 1A, 1B, 1C:
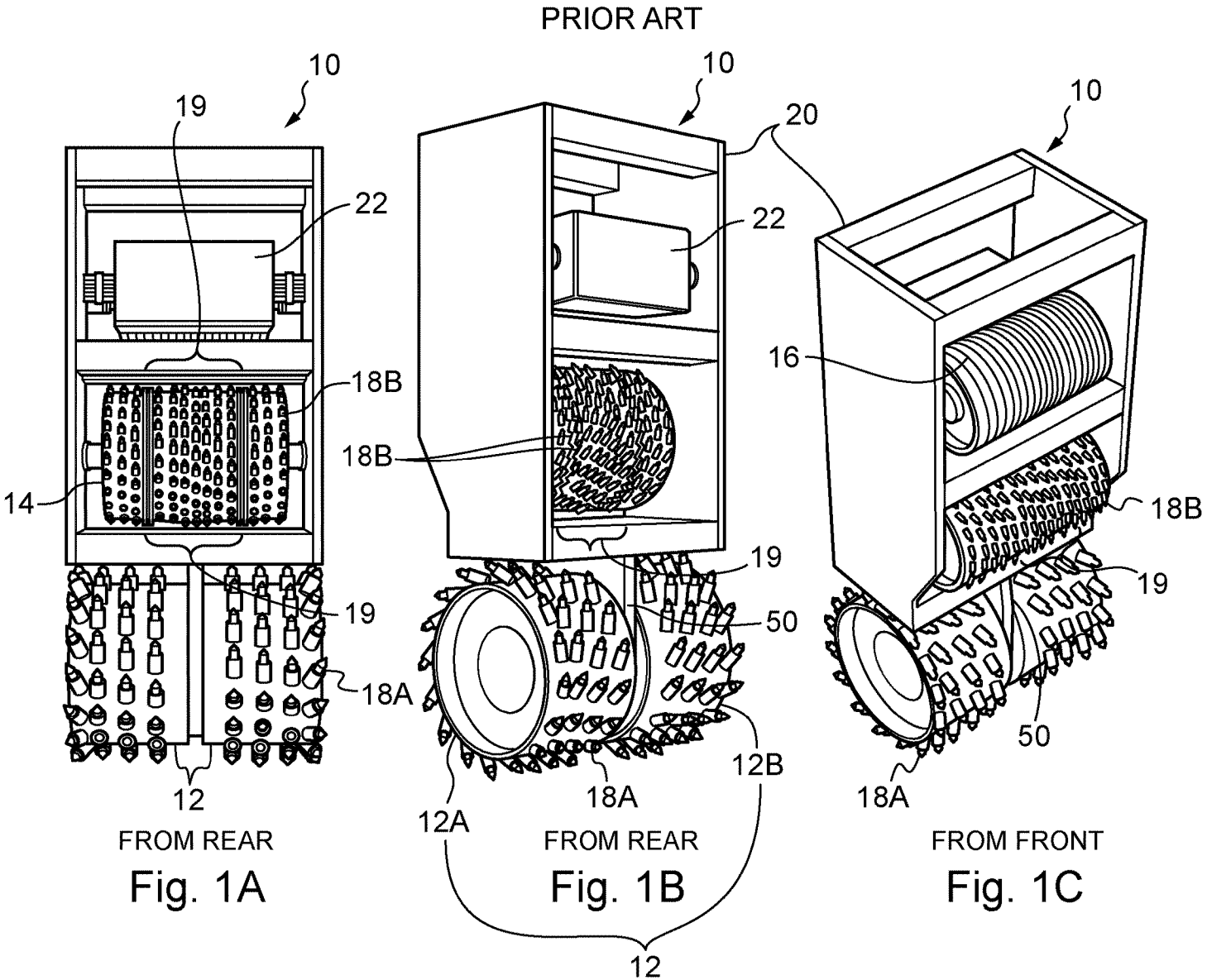
FIGS. 1A, 1B and 1C show, respectively, rear elevation, rear perspective and front perspective views of a prior art mill described in WO2013/007968 COUPLAND.

In the previous and following descriptions, diaphragm walls are referred to, for ease of reference, as a particularly suitable example of the application of the invention. Nevertheless, it is to be understood that various concrete embedded retaining walls such as diaphragm walls, slurry walls, contiguous pile walls, and secant pile walls and the like may also be constructed using the principles of the invention requiring a joint between two panels and the term diaphragm wall is to be understood to include such other walls and piles unless the context requires otherwise. Concrete is referred to throughout for clarity and simplicity, but it will be well understood that the invention applies to any flowable, hardenable material.

Furthermore the previous and following descriptions refer to panels that are typically planar and rectangular in cross-section, having two generally planar substantially parallel "side" faces and two generally planar, substantially parallel "end" faces. However, it is to be understood the invention may be used with other shaped panels such as "panels" of circular or other (e.g. hexagonal) cross-sections such as piles. Whilst the apparatus and methods of the invention are particularly described herein in relation to "end" faces (also known as "end" walls) of generally rectangular concrete panels, it is to be understood that the apparatus and methods of the invention can be used in relation to "side" faces (also known as "side" walls) of a rectangular panel, "end" and/or "side" faces (also known as "end" and/or "side" walls) of a rectangular panel or indeed faces (also known as walls) of another shaped "panel" such as a circular "panel". The term "panel" should be interpreted to include these various embodiments except where the context determines otherwise.

Notably, it will be understood by those skilled in the art that any dimensions, and any directions such as vertical or horizontal, referred to in this application are within expected construction tolerances and limits for building diaphragm walls and these terms should be construed with this in mind.

A first concrete panel has an end face that is approximately vertical over its length. This verticality is determined by a first cutting machine, typically a grab or a mill with two opposing wheels, used to excavate the trench for the first panel. Similarly the verticality of the walls of the second excavated trench may be determined by the cutting machine, typically an existing grab or mill with two opposing wheels, used to excavate the trench for the second panel. The first panel and the second panel are typically rectangular in cross-section. Typically a narrow soil column may be left in between the first panel and the newly excavated trench for forming a second panel. Prior art grabs (not shown), and mills, are guided by gravity and may be subject to sideways movement during excavation due to the ground it encounters. The end face of the first panel may therefore deviate from vertical. WO2013/007968 COUPLAND uses a guideway tube and guide to hold a milling apparatus adjacent to the end face of the first panel regardless of its verticality.

FIGS. 1A, 1B and 10 show a prior art mill 10 described in WO2013/007968 COUPLAND having a vertical rectangular box frame 20 supporting a lower central support pillar 50 on which a cutting assembly comprising lower spaced apart mill wheels 12 (12A, 12B) are mounted along a common horizontal axis. Lower wheels 12A and 12B are of identical size and each comprise a set of cutting teeth 18A for milling (and so preparing) an end face of a concrete panel formed in the ground, suitable for a joint. Typically, an upper mill wheel 14 is provided within frame 20 as part of the cutting assembly for reasons explained below. The upper mill wheel has a series of smaller teeth 18B for providing a finer milled surface, and a raised central region 19 which will mill the wall in the region above the central lower support pillar 50 e.g. to provide a vertical rebate with a circuitous path for an improved joint. A motor 22 may be provided. An optional uppermost mill wheel 16 may also be provided for a final fine mill preparation of the end face of the concrete panel.

Figure 2A:
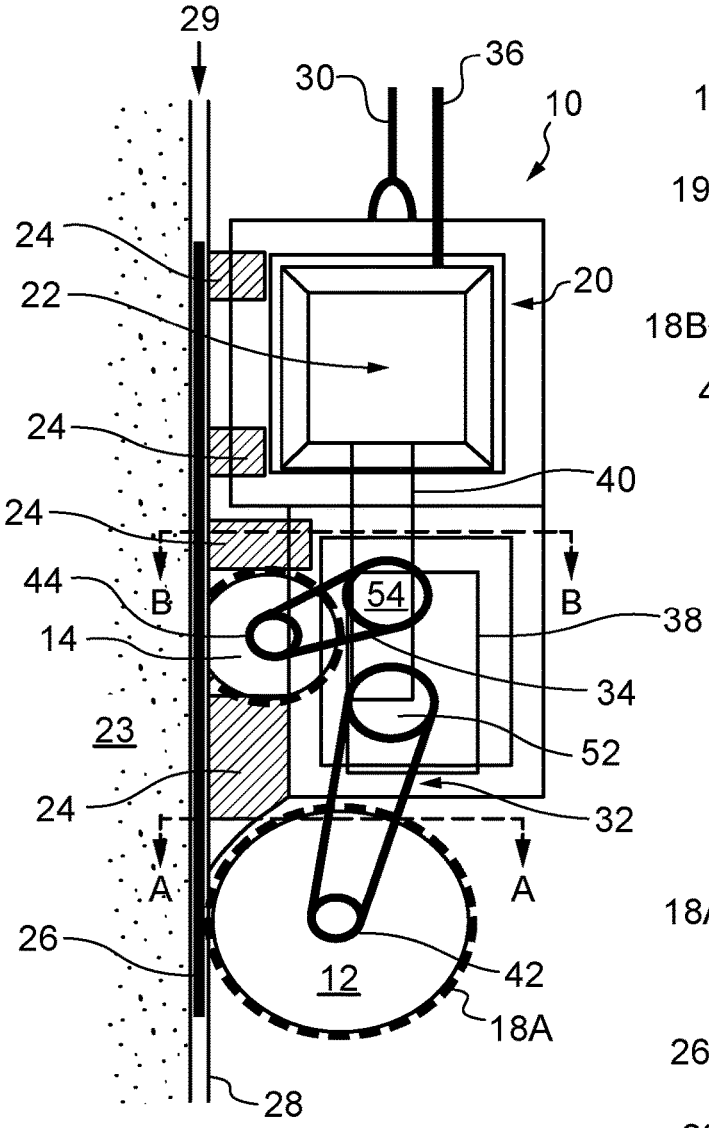
FIGS. 2A, 2B and 2C show, respectively, side elevation, plan view along section AA and plan view along section BB of a prior art mill described in WO2013/007968 COUPLAND.
Figure 2C:
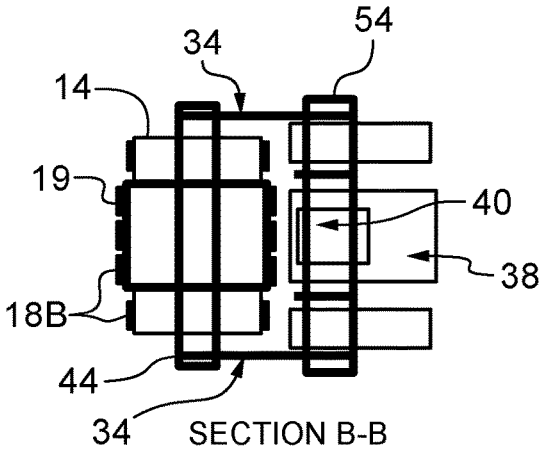
Figure 2B:
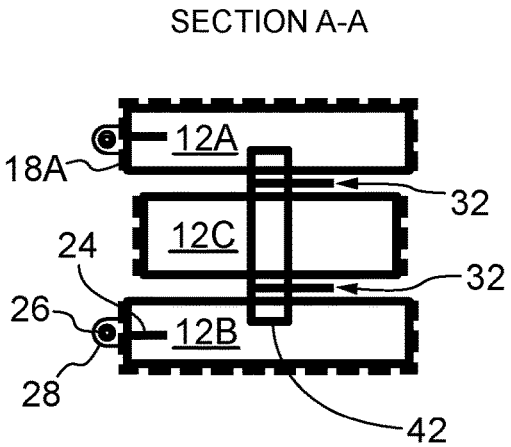

FIGS. 2A, 2B and 2C show a variation of the prior art mill 10 of FIGS. 1A, 1B and 10 in which frame 20 is supported on cable 30 and provided with a hydraulic hose(s) 36. Frame 20 is provided with multiple guide mounts 24 on which is mounted an elongate vertical guide 26. As described in WO2013/007968 COUPLAND, guide 26 travels in a guideway tube 28 embedded along a (vertical) end face 29 of a first concrete panel (23) to hold mill 10 adjacent to the concrete panel during cutting. Mill teeth 18A on mill wheels 12 are used to mill end face 29 of first concrete panel 23, typically on a downward pass of milling machine 10, so opening guideway tube(s) 28 for guides 26 on guide supports 24 to travel in the now open guideway tube 28 holding milling machine 10 to end face 29 and resisting lateral horizontal forces away from the end face 29. The milling teeth cut away any remaining soil column left adjacent the end face 29 of first concrete panel 24 and a thin layer of concrete on end face 29 to provide a prepared end face ready to form a joint with the next concrete panel.

This prepared end face forms a clean, well defined, accurately positioned surface with which to form a joint with the neighboring second panel. Here, two spaced lower mill wheels 12 (12A, 12B) are supplemented by an upper mill wheel 14 of smaller diameter and, optionally, a central mill wheel 12C also of smaller diameter along a common horizontal axis. Mill wheels 12 (12A, 12B, 12C) are mounted on a common axle 42 which is driven to rotate by a lower drive gear 52 and a lower drive train 32. Upper wheel 14 is mounted on an upper wheel axle 44 which is driven to rotate by an upper drive gear 54 and an upper drive train 34. Motor 22 powers drive gears 52 and 54 via a linking drive train 40 and gearbox 38.

In both FIGS. 1 and 2, a second upper wheel 14 is provided to mill across a central region of the end face of the concrete panel overlapping an un-milled region left in the cut (milled) surface of the end face 29 corresponding to the gap between the two spaced apart outer cutting wheels 12A and 12B. When using an additional inner cutting wheel as in FIG. 2B there are two spaced apart, un-milled regions left along the height of the end face of the first concrete panel 23 corresponding to the two gaps between adjacent pairs of lower wheels 12, between 12A and 12C and between 12C and 12B. The action of an additional upper wheel 14 overlaps these un-milled regions preparing the end face 29 across its whole width. The mill shown in FIGS. 1 and 2 is complex, requiring multiple drive trains to multiple wheels of differing diameter and at differing (height) levels of the mill.

Figure 3C:
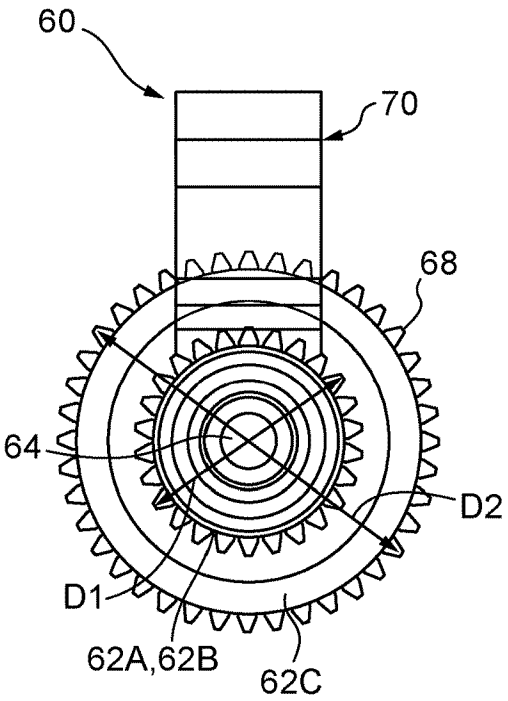
FIGS. 3A, 3B and 3C show, respectively, front sectional elevation, front elevation and end sectional elevation of an improved cutting assembly according to the invention.
Figure 3B:
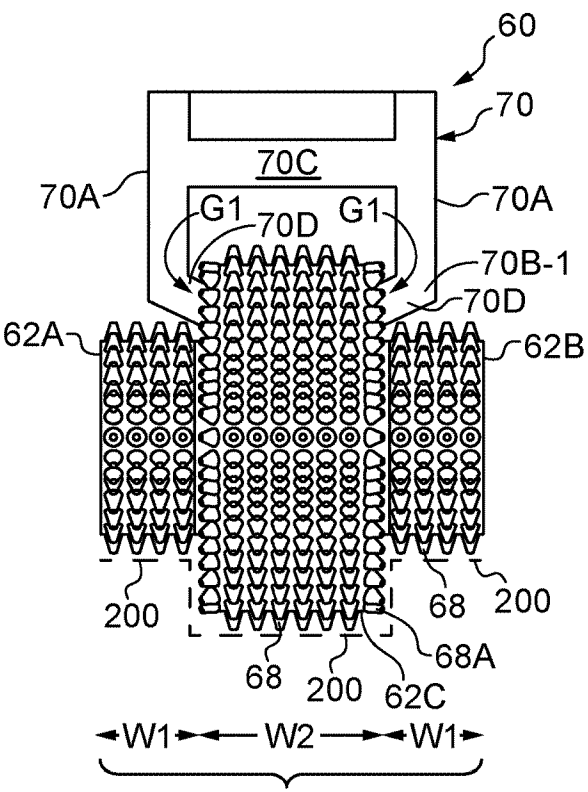
Figure 3A:
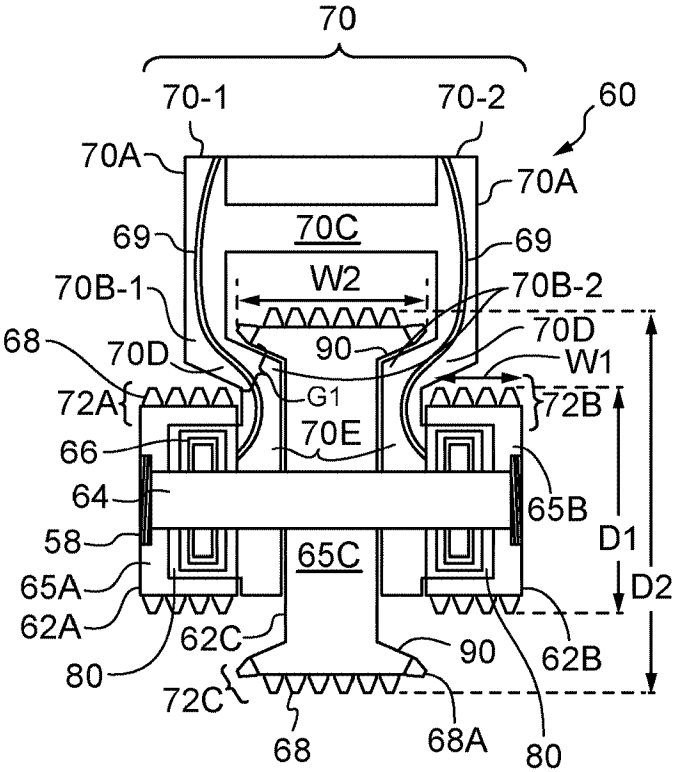

FIGS. 3A, 3B and 3C show a first cutting wheel assembly 60 for use with a milling machine, such as those shown in FIGS. 1 and 2, for cutting a trench and/or for cutting along the height of a concrete panel, having a frame 70 and three cutting wheels 62 (62A, 62C, 62B) mounted on it. Whilst two wheels may be provided, three or more symmetrically arranged abut a vertical centre line through the cutting assembly is preferred to reduce the risk of the assembly being subject to turning forces from uneven cutting actions.

Frame 70 is forked having two support pillars 70-1, 70-2 which are generally vertical and spaced apart from one another, here by horizontal cross-strut 70C. Generally vertical pillars 70-1, 70-2 each comprise respective upper portions 70A, first bend portions 70B-1 leading to respective intermediate portions 70D at an angle to the vertical direction (here inclined inwardly and downwardly narrowing their separation and leading to a second bend portion 70B-2), second bend portions 70B-2 and lower portions 70E which, here, are substantially vertical. A drive shaft 64 is mounted to lower portions 70E in a rotatable manner. Drive shaft 64 defines a common axis of rotation about which three cutting wheels 62 (62A, 62B, 62C) are provided. Two outer cutting wheels 62A and 62B are located either side of inner cutting wheel 62C operatively mounted on drive shaft 64. Outer cutting wheels 62A and 62B may be fixedly mounted on drive shaft 64 by a recessed threading lock nut 58 or by other mechanisms which would be understood by those skilled in the art.

The central hub portions 65A, 65B of the outer cutting wheels 62A and 62B are each provided with opposing recesses 80 (with opposing openings) within which one or more hydraulic motor(s) for driving drive shaft 64 may be provided. Hydraulic power lines 69 may be provided adjacent to or, indeed, within hollow sections of pillars 70-1, 70-2.

In this example, outer cutting wheels 62A and 62B are of the same shape, diameter and width. Each outer cutting wheel 62A and 62B has an annular cutting portion 72A, 72B defining a first cutting diameter D1 and a first cutting width W1, and located about a central hub portion 65A, 65B. The inner cutting wheel 62C has an annular cutting portion 72C defining a second cutting diameter D2 and a second cutting width W2, located about a central hub portion 65C.

In this example, the second cutting diameter D2 of inner cutting wheel 62C is greater than the first cutting diameter D1 of outer cutting wheels 62A and 62B. The first and second cutting widths W1 and W2 may the same or different, but it is preferred that both the outer cutting wheels 62A, 62B have annular cutting portions 72A, 72B of the same cutting widths W2 (and preferably the same cutting diameters D2). Indeed, preferably the cross-sections of the outer wheel annular cutting portions 72A, 72B, and preferably also the outer cutting wheels 62A, 62B, are mirror images of one another (as seen best in FIG. 4A) so these provide a symmetric cutting action either side of central vertical line on the surface to be cut.

Each cutting wheel 62A, 62B and 62C is generally drum-shaped and has an annular cutting portion respectively 72A, 72B and 72C about their respective hub portions 65A, 65B, 65C. It will be noted that the annular cutting portion of inner wheel 62C is enlarged, being wider (W1) than the width (not labelled) of its corresponding hub portion 65C.

All the wheels are provided with cutting teeth 68 which may be of any suitable size, shape, orientation and distribution. Here, teeth 68 are provided in linear rows across, and linear columns about, the outermost surface of each cutting wheel 62A, 62C, and 62B (forming part of annular cutting portions 72A, 72C and 72B). It will be appreciated that gaps may be left between rows of teeth on the annular cutting portions but the distribution and separation of teeth across the annular cutting portions is arranged to be such as to provide a suitably prepared cut surface with few if any unprepared (uncut) regions of concrete following cutting by annular cutting portions 72A, 72B, 72C, as would be well understood by those skilled in the art.

In this invention, inner wheel annular cutting portion 72C has an outwardly extending inclined wall 90 provided on a rim portion extending about its periphery and a series of angled cutting teeth 68A, here at approximately 45° to the horizontal (and vertical) and generally in line with inclined wall 90. Inclined wall 90 (which here is a frustoconical shape) of annular cutting portion 72C is sized and shaped to co-operate with inwardly extending inclined opposing wall(s) of intermediate portions 70D of pillars 70-1, 70-2.

The inner cutting wheel 62 is located in between and spaced apart from outer cutting wheels 62A and 62B by a gap G1 of predetermined shape into which the angled (here inclined) intermediate portions 70D of downwardly depending support pillars 70A and 70B are received. The size and shape of gap G1 is defined by the separation of opposing portions of the annular cutting portions of the inner, and respective outer, cutting wheels 62A, 62B, and 62C.

Here gap G1 is defined by the separation of inner wheel inclined wall 90 and the closest opposing portion of outer cutting wheel annular cutting portions 72A, 72B. Preferably, gap G1 has an opening that faces laterally outwards away from inner wheel 62C (in a horizontal direction). The opening of gap G1 may also face upwardly or downwardly (in other words the opening to gap G1 may be inclined) but the provision of access to the gap G1 in at least a lateral direction facilitates the provision of an overlapping cutting portion on inner wheel 72C (in this example). Gap G1 may be of any suitable shape, here it is a general frustoconical shape, and in cross-section is generally rectangular (as best seen in FIGS. 3A and 4A). Gap G1 receives the, preferably correspondingly shaped, intermediate portions 70D of pillars 70-1, 70-2. Gap G1 leads into a further generally cylindrical gap of rectangular cross-section (not labelled) between the neighboring central hub portions (65A to 65C, and 65C to 65B) into which the lower portions 70E of pillars 70-1, 70-2 are received.

Rather than being at an angle e.g. an obtuse angle of between 90° to 180°, to the vertical, intermediate portions 70D, may be at a right angle to the vertical so that if the upper and lower portions are vertical, these extend in a horizontal direction, and gap G1 may be sized and/or shaped to correspond to and accommodate this arrangement.

In use, hydraulic liquid is pumped via hydraulic hoses 69 powering hydraulic motors 66 and causing drive shaft 64 to rotate. Wheels 62A, 62B and 62C are mounted on drive shaft 64 and rotate about it in a synchronous manner. In this way, the wider diameter wheel(s) have an annular cutting portion with a higher rotational velocity than the narrower diameter wheel(s). As well as the rotational speed of the annular cutting portion, the nature of the cutting action is also governed by the teeth spacing (and orientation) in the annular cutting portion(s). Wheels 62A and 62B remove a desired amount of concrete from a vertical end face of a concrete panel determined by the distance of the drive shaft from the uncut end face. Similarly, inner cutting wheel 62C cuts a deeper predetermined depth of concrete from the end face of the concrete panel again determined by the lateral distance of the drive shaft from the concrete panel which is determined by the location of drive shaft 64 on a mill frame 20 such as that shown in FIG. 2A.

Milling apparatus (such as that shown in in FIGS. 1 and 2) with a cutting assembly 60 (as shown in FIGS. 3 and 4) may be anchored to the vertical height of an end face of a concrete panel with one or more guides, resisting lateral extraction forces and pressing inner cutting wheel 62C (in particular) as well as outer cutting wheels 62A, 62B against the concrete wall during cutting. A vertical rebate is produced in a line of cut as shown by the dotted line of cut 200 in FIG. 3B. Such a rebate in a concrete panel is preferred as this provides a circuitous path resisting horizontal transfer of water through the diaphragm wall improving the effectiveness of a joint between neighboring concrete panels.

As an alternative to the guided mill apparatus shown in FIG. 2A, two opposing co-operating wheel sets, having drive shafts parallel but laterally spaced to one another, may be provided, the second wheel set pushing against a rear wall of a trench dug either at the same time or in a prior step), so as to force the first wheel set against the end face of the concrete panel. This arrangement, using two opposing wheel sets to co-operate with one another and push against a concrete panel and an opposing trench wall, is well known in the art.

A cross-strut 70C may be used to connect generally vertical downwardly depending support pillars 70-1 and 70-2. Cross-strut 70C is typically wider than cutting width W2 of inner cutting wheel 62C. Inclined teeth 68A are located about the rim of the annular cutting portion 72C of wheel 62C. In this embodiment as shown best in FIG. 3B the extent of the cutting provided by teeth 68 and 68A is a width W2 which abuts a corresponding width W1 of annular cutting portion 72A of wheel 62A. The difference in cutting diameter of inner cutting wheel 62C compared to outer cutting wheel 62A and 62B means that there is a gap G1 exposing the central hub region 65C of inner cutting wheel 62C. It is into this gap that portions, here inclined, intermediate portions 70D of pillars 70-1 and 70-2, are provided. Indeed, central hub portion 65C is, in effect, recessed having an enlarged annular cutting portion 72C about its periphery. Into the recess provided by central hub 65C, inclined pillar portions 70D and lower (substantially vertical) pillar portions 70E are received. Hydraulic motors 66 and drive shaft 64 are mounted on lower pillar portions 70E. Central hub portions 65A and 65B of outer cutting wheels 62A and 62B are U-shaped in cross-section to provide a recess 80 into which one or more hydraulic motor(s) 66 can be provided. Whilst it is not shown, it will be understood that alternatively, one or more hydraulic motors may be provided within a recess of central hub portion 65C of inner cutting wheel 62C.

When used with a guided milling apparatus such as that shown in FIGS. 1 and 2, the cutting wheel assembly 60 can be passed along a vertical height of an end face of a first concrete panel removing any remaining soil column and concrete, and preparing the surface for a further adjacent concrete panel to be poured. The overall cutting width W of the cutting assembly 60 (seen best in FIG. 3B) comprises the cutting width W1 of cutting wheel 62A, the cutting width W2 of inner cutting wheel 62C and the cutting width W1 (again) of wheel 62B. As the lateral extent of gap G1 is overlapped by the outer rim portion (including inclined wall 90) of annular cutting portion 72C of inner wheel 62C, these cutting widths (when seen from the front) abut one another without leaving a gap in the line of cut 200 (see FIG. 3B). Indeed, cutting width W2 may overlap the cutting widths W1 of the outer cutting wheels, if the outer rim portion (including inclined wall 90) of annular cutting portion 72C extends beyond the first teeth of the outer cutting wheels 62A, 62B. In either case, a central portion of an end face (opposite inner wheel 62C) will be cut to a greater depth than outer portions either side (opposite outer cutting wheels 62A, 62B). The additional depth is equal to (D2−D1)/2 which might, for example, be 5 to 20 cm or, more typically, 10 to 15 cm. Thus, annular cutting portions 72A, 72B and 72C of cutting wheels 62A, 62B and 62C provide a continuous line of cut (with a rebate for a shear joint) across the full cutting width W of the machine with minimal gaps.

Figure 4C:
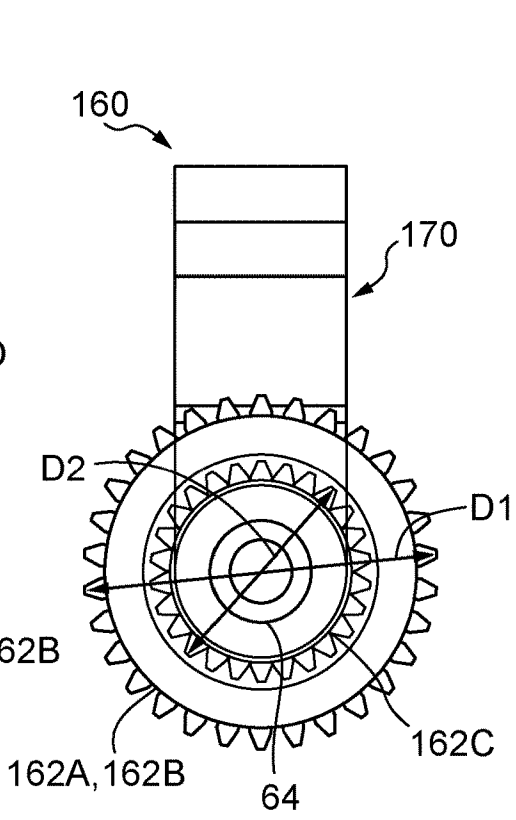
FIGS. 4A, 4B and 4C show, respectively, front sectional elevation, front elevation and end sectional elevation of an alternative, improved cutting assembly according to the invention.
Figure 4B:
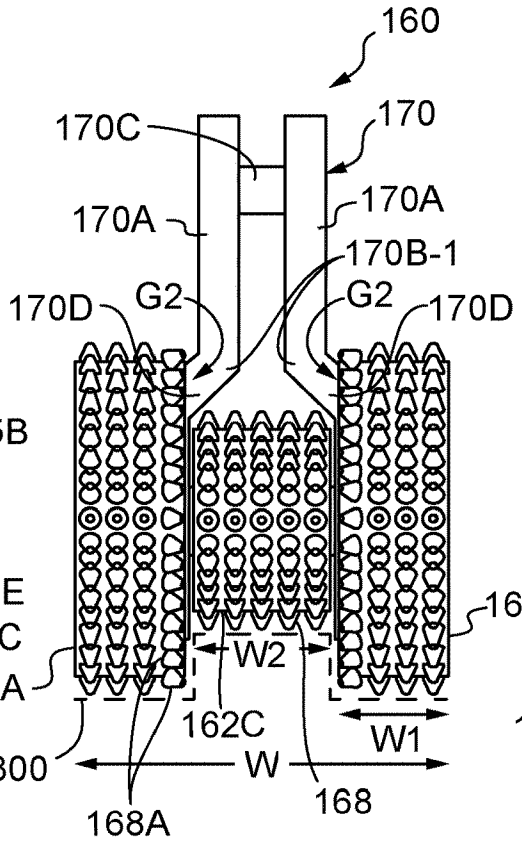
Figure 4A:
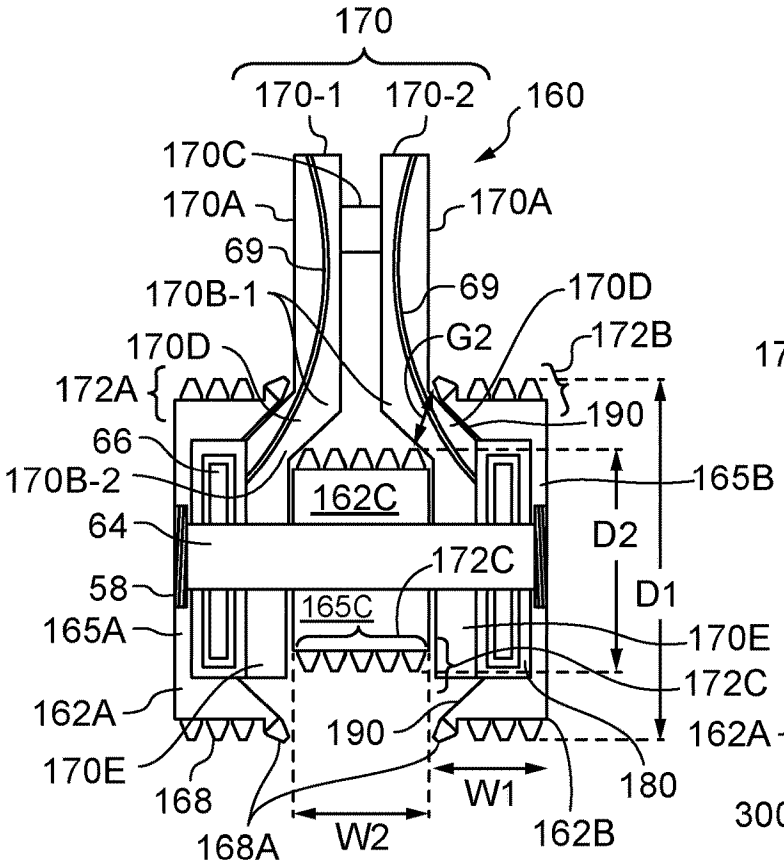

FIGS. 4A, 4B and 4C show an alternative embodiment in which the cutting diameter D2 of a central cutting wheel 162C is less than the cutting diameter D1 of outer cutting wheels 162A, 162B. Here, a cutting assembly 160 comprises a frame 170 with two downwardly depending pillars 170-1, 170-2, more narrowly spaced than those shown in FIG. 3, with a cross-strut 170C, first bend portions 170B-1, outwardly extending inclined intermediate portions 170D, second bend portions 170B-2, and terminating in lower portions 170E.

Outer cutting wheels 162A, 162B are provided with a recess for (here) each receiving hydraulic motors 66 about the central common drive shaft 64. Hydraulic power lines deliver hydraulic fluid to hydraulic motors 66. In this case, it is outer cutting wheels 162A, 162B which are provided with enlarged annular cutting portions 172A, 172B with cutting teeth 168 and inclined cutting teeth 168A which point inwardly towards inner cutting wheel 162C. Enlarged annular cutting portions 172A, 172B have an inclined inner wall 190 (of an outer rim portion) which terminates in inclined cutting teeth 168 about its periphery. Inner walls 190 are, again, frustoconical shaped and co-operate with the outermost inclined walls of intermediate portions 170D to allow rotation of outer cutting wheels 162A, 162B. Thus, intermediate portions 170D pass within the gaps G1 formed between central hubs 165A and 165C of left hand wheel 162A and inner cutting wheel 162C and between central hubs 165C and 165B of inner cutting wheel 162C, and right hand wheel 162B.

Here, inner cutting wheel 162C is a substantially cylindrical drum with an annular cutting portion 172C. It can be seen from FIG. 4B that the lateral cutting width is made up of cutting width W1 of outer cutting wheels 162A and 162B, and cutting width W2 of inner cutting wheel 162C. Because outer cutting wheels 162A and 162B are of greater diameter than inner cutting wheel 162C, the central hub portions 165A, 165B of outer cutting wheels 162A, 162B are exposed providing access (via gaps G1) to respective recesses 180 into which hydraulic motors can be located. As with the cutting assembly shown in FIG. 3, one or more hydraulic motors may instead be provided in hub 165C of inner cutting wheel 162C. It will also be appreciated that, whereas in this case the cutting teeth 168A and 168 on inner cutting wheel 162C essentially provide abutting cutting regions (of widths W1 and W2 respectively), teeth, and so these cutting regions, may overlap which, in effect, would mean that the outermost, peripheral cutting teeth 168 of inner cutting wheel 162C may not engage the surface to be cut. A cut line 300 (comprising widths W1, W2 and W1 (again)) is provided by the cutting action of wheels 162A, 162B and 162C shown here. A central protruding concrete portion corresponding to the smaller cutting diameter D2 of inner cutting wheel 162C remains, protruding in the final cut end face of the concrete panel. Again, this cut line 300 provides a circuitous route (by providing an elongate protruding portion along the height of the cut end face) helping to prevent lateral water flow through adjoining concrete panels.

In one embodiment, the invention provides a cutting wheel assembly for cutting, with a (first) pair of spaced outer cutting wheels either side of an inner cutting wheel all arranged on a common axle; the two outer cutting wheels having respective cutting diameter(s); the inner cutting wheel having a different cutting diameter to either of the outer cutting wheels; the inner and each respective outer cutting wheel defining a respective gap, preferably the gap having an opening that faces outwards in a lateral direction; the assembly also having a forked support frame with two forks received in the respective gaps either side of the inner cutting wheel to support the axle and preferably, a recess in one or both outer cutting wheels or in the inner cutting wheel to receive a (hydraulic) motor; the inner cutting wheel and the outer cutting wheels having respective cutting widths and at least one of the central cutting wheel and the outer cutting wheels having an annular cutting portion with a rim portion that overlaps a respective gap to provide a laterally continuous cutting region (line of cut) across the cutting wheels.

The teeth are preferably all the same (constant) height above an outermost surface portion of the annular cutting portion of each wheel. Preferably, the cutting wheels are substantially circular in cross-section, and also the annular cutting portions of each wheel are also substantially circular in cross-section, providing a pre-determined (preferably constant) radius of cut.

By providing a continuous (or near continuous) line of cut an end face of a concrete panel can be fully prepared with no gaps across its surface using a cutting assembly with a simpler more robust arrangement of cutting wheels.

The invention claimed is:

1. A cutting wheel assembly comprising:

a frame having two spaced support pillars, each pillar having an upper portion, an intermediate portion and a lower portion, the intermediate portion arranged at an angle to the upper and lower portions; and a pair of outer cutting wheels arranged on either side of an inner cutting wheel, wherein the outer cutting wheels and the inner cutting wheel are each supported on the lower portions of the support pillars in a rotatable manner about a common axis of rotation, wherein each of the outer cutting wheels and the inner cutting wheel having a central hub portion about which an annular cutting portion is provided, each annular cutting portion having a respective cutting diameter, wherein the inner cutting wheel has a different cutting diameter than to that of both the outer cutting wheels, and the central hub portions of neighboring cutting wheels defining a respective gap in which the intermediate portion of a respective pillar is received, and wherein at least one of the annular cutting portions of the inner cutting wheel and/or the outer cutting wheels has one or more rim portion(s) that overlap each gap, so the annular cutting portions of the cutting wheels provide a cutting action along a continuous line of cut in a lateral direction.

2. An assembly according to claim 1, wherein the annular cutting portions of the outer cutting wheels both have the same first cutting diameter, and the annular cutting portion of the inner cutting wheel has a second cutting diameter which is different from the first cutting diameter.

3. An assembly according to claim 2, wherein the first cutting diameter of the outer cutting wheels is larger than the second cutting diameter of the inner cutting wheel.

4. An assembly according to claim 2, wherein the first cutting diameter of the outer cutting wheels is smaller than the second cutting diameter of the inner cutting wheel.

5. An assembly according to claim 1, wherein each annular cutting portion of each wheel has a respective cutting width and in which the respective cutting widths of the annular cutting portions at least one of abut or overlap one another to provide a cutting action along a continuous line of cut in a lateral direction.

6. An assembly according to claim 1, wherein the gap between neighboring cutting wheels has an opening which faces in a lateral direction.

7. An assembly according to claim 1, wherein the central hub portion of at least one of the outer cutting wheels and/or the inner cutting wheel, comprises a recess to receive a motor.

8. An assembly according to claim 7, wherein at least one power line is located within one or both support pillars to provide at least one central hub portion with power.

9. An assembly according to claim 1, wherein the inner cutting wheel is of greater cutting diameter than the outer cutting wheels and the annular cutting portion of the inner cutting wheel is wider than its central hub portion, thereby defining a recess.

10. An assembly according to claim 1, wherein the inner cutting wheel is of lesser cutting diameter than the outer cutting wheels and each outer cutting wheel has an annular portion wider than its central hub portion, thereby defining a recess.

11. An assembly according to claim 1, wherein each support pillar has an inclined intermediate portion between upper and lower vertical portions.

12. An assembly according to claim 11, wherein the intermediate portion of each support pillar is at an obtuse angle to the upper and lower portions.

13. An assembly according to claim 1, wherein the intermediate portion of each support pillar is at an angle of substantially, 90° relative to the upper and lower portions.

14. An assembly according to claim 1, wherein each support pillar has a horizontal intermediate portion between upper and lower portions.

15. An assembly according to claim 1, wherein each support pillar has a first bend between straight upper and intermediate portions to provide a first change in direction, so that the intermediate portion is at an angle to the upper portion.

16. An assembly according to claim 15, wherein each pillar has a second bend between straight intermediate and lower portions to provide a second change in direction so that the intermediate portion is at an angle to the lower portion.

17. An assembly according to claim 1 wherein at least one intermediate portion extends inwardly toward the inner cutting wheel.

18. An assembly according to claim 1, wherein at least one intermediate portion extends outwardly away from the inner cutting wheel.

19. An assembly according to claim 1, wherein the upper and lower portions of the support pillars are substantially vertical.

20. A method of cutting a trench or an end face of a concrete panel comprising using the apparatus of claim 1.

* * * * *